US010895840B2

(12) United States Patent
Ichihashi et al.

(10) Patent No.: US 10,895,840 B2
(45) Date of Patent: Jan. 19, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Naoaki Ichihashi, Kashiwa (JP); Yasuhiro Kawai, Abiko (JP); Hironori Owaki, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/681,982

(22) Filed: Nov. 13, 2019

(65) Prior Publication Data

US 2020/0159135 A1 May 21, 2020

(30) Foreign Application Priority Data

Nov. 16, 2018 (JP) ..... 2018-215801

(51) Int. Cl.
*G03G 15/00* (2006.01)
*G03G 5/05* (2006.01)
*G03G 5/047* (2006.01)

(52) U.S. Cl.
CPC ..... *G03G 15/751* (2013.01); *G03G 5/047* (2013.01); *G03G 5/0525* (2013.01)

(58) Field of Classification Search
CPC ..... G03G 15/75; G03G 15/751; G03G 5/04
See application file for complete search history.

(56) References Cited

U.S. PATENT DOCUMENTS

| | | | |
|---|---|---|---|
| 6,636,715 | B2 | 10/2003 | Kawamura et al. |
| 7,229,731 | B2 | 6/2007 | Aoki et al. |
| 7,622,238 | B2 | 11/2009 | Uematsu et al. |
| 7,813,675 | B2 | 10/2010 | Tanabe et al. |
| 8,457,528 | B2 | 6/2013 | Ochi et al. |
| 8,783,209 | B2 | 7/2014 | Kaku et al. |
| 9,114,565 | B2 | 8/2015 | Kawai et al. |
| 9,389,521 | B2 | 7/2016 | Takahashi et al. |
| 9,766,561 | B2 | 9/2017 | Takahashi et al. |
| 9,772,596 | B2 | 9/2017 | Mitsui et al. |
| 10,042,273 | B2 | 8/2018 | Takahashi et al. |

(Continued)

FOREIGN PATENT DOCUMENTS

| | | |
|---|---|---|
| JP | H08-179521 A | 7/1996 |
| JP | 2007-233356 A | 9/2007 |

(Continued)

*Primary Examiner* — Carla J Therrien
(74) *Attorney, Agent, or Firm* — Venable LLP

(57) ABSTRACT

Provided is a cylindrical electrophotographic photosensitive member, including a concave/convex portion forming region in which at least one of concave portions and convex portions are formed on a surface of the electrophotographic photosensitive member from a central portion to both end portions in an axial direction of the electrophotographic photosensitive member, wherein a maximum value Lmax and a minimum value Lmin of a distance L from the central portion to one end portion of the concave/convex portion forming region in the axial direction of the surface of the electrophotographic photosensitive member satisfy a specific relation.

4 Claims, 13 Drawing Sheets

(56) References Cited

U.S. PATENT DOCUMENTS

| | | | | |
|---|---|---|---|---|
| 10,338,486 | B2 | 7/2019 | Abe et al. | |
| 10,359,729 | B2 | 7/2019 | Ichihashi et al. | |
| 2006/0110173 | A1* | 5/2006 | Yamamoto | G03G 21/0011 399/44 |
| 2006/0194132 | A1 | 8/2006 | Hosoi et al. | |
| 2009/0317734 | A1* | 12/2009 | Takeda | G03G 15/751 430/60 |
| 2014/0093281 | A1 | 4/2014 | Takahashi et al. | |
| 2015/0286182 | A1* | 10/2015 | Mitsui | G03G 15/751 399/159 |
| 2019/0072865 | A1 | 3/2019 | Ohira et al. | |
| 2020/0081359 | A1* | 3/2020 | Fujiwara | G03G 5/14708 |

FOREIGN PATENT DOCUMENTS

| | | | |
|---|---|---|---|
| JP | 4059518 | B2 | 3/2008 |
| WO | 09/014262 | A1 | 1/2009 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge, and an electrophotographic apparatus.

Description of the Related Art

Since on a surface of a cylindrical electrophotographic photosensitive member (hereinafter, simply referred to as electrophotographic photosensitive member), an electrical external force or a mechanical external force such as electrostatic charge or cleaning is applied, durability (such as wear resistance) against these external forces is required.

In response to the requirement, conventionally, improvement techniques such as using a resin having high wear resistance (such as a curable resin) on a surface layer of the electrophotographic photosensitive member, have been used.

On the other hand, examples of a main problem that arises by increasing wear resistance on the surface of the electrophotographic photosensitive member include an influence on cleaning performance performed by a cleaning blade. As a method of overcoming the problem, a method in which concave portions and convex portions of the electrophotographic photosensitive member are formed and the surface is appropriately roughened, thereby decreasing a contact area between the surface of the electrophotographic photosensitive member and the cleaning blade and reducing a frictional force, has been proposed.

For example, a method for transferring a fine shape to the surface of the electrophotographic photosensitive member is disclosed in Japanese Patent No. 4059518. The method is excellent in terms of diversity and controllability of shapes to be transferred.

Roughening of the surface of the electrophotographic photosensitive member is generally performed uniformly within a necessary range, and conventionally, has been performed on the area which the cleaning blade abuts.

SUMMARY OF THE INVENTION

The above object is achieved by the present invention described below. That is, the electrophotographic photosensitive member according to one embodiment of the present invention is a cylindrical electrophotographic photosensitive member, including a concave/convex portion forming region in which at least one of concave portions and convex portions are formed on a surface of the electrophotographic photosensitive member from a central portion to both end portions in an axial direction of the electrophotographic photosensitive member, wherein a maximum value Lmax and a minimum value Lmin of a distance L from the central portion to one end portion of the concave/convex portion forming region in the axial direction of the surface of the electrophotographic photosensitive member satisfy the following Relational Expression (1):

$$0.006 \leq (Lmax - Lmin)/Lmax \leq 0.116 \quad \text{Expression (1).}$$

Further features of the present invention will become apparent from the following description of exemplary embodiments with reference to the attached drawings.

DESCRIPTION OF THE EMBODIMENTS

Figure 1:
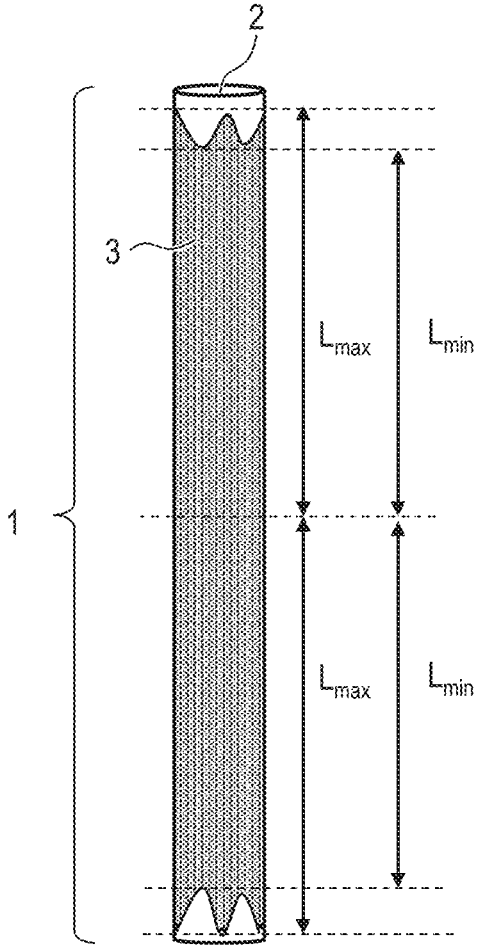
FIG. 1 is a drawing illustrating an appearance of an example of an electrophotographic photosensitive member according to one embodiment of the present invention.

An electrophotographic photosensitive member abuts various members in addition to a cleaning blade, in an electrophotographic apparatus. These members are used while causing a slight deviation in an axial direction of the electrophotographic photosensitive member in an electrophotographic process.

When a shape is transferred using a mold member as in Japanese Patent No. 4059518, an end portion of a concave/convex portion forming region in the axial direction of the electrophotographic photosensitive member is a straight line in a circumferential direction.

When in the axial direction of the electrophotographic photosensitive member, an end of a concave/convex portion forming region exists more outside than an area which a cleaning blade abuts and an end portion of a member abutting the electrophotographic photosensitive member deviates across the end of the concave/convex portion forming region, a frictional force with the electrophotographic photosensitive member changes a lot. As a result, stress concentrates on the end portion of the abutting member and scratches and wear which cause deterioration of the abutting member occur.

An object of the present invention is to provide an electrophotographic photosensitive member which can suppress a large change in a frictional force between the surface of the electrophotographic photosensitive member and an abutting member and extend a life of a member abutting the electrophotographic photosensitive member. Further, another object of the present invention is to provide a process cartridge and an electrophotographic apparatus which have the electrophotographic photosensitive member and can be stably used over a long period of time.

The electrophotographic photosensitive member according to one embodiment of the present invention is a cylindrical electrophotographic photosensitive member, including a concave/convex portion forming region in which concave/convex portions are formed on a surface of the electrophotographic photosensitive member from a central portion to both end portions in an axial direction of the electrophotographic photosensitive member.

Further, a maximum value Lmax and a minimum value Lmin of a distance L from the central portion to one end portion of the concave/convex portion forming region in the axial direction of the surface of the electrophotographic photosensitive member satisfy the following Relational Expression (1):

$$0.006 \leq (L\max - L\min)/L\max \leq 0.116 \quad \text{Expression (1).}$$

A main difference between the electrophotographic photosensitive member according to one embodiment of the present invention and a conventionally known electrophotographic photosensitive member having concave/convex portions formed on the surface will be described.

Hereinafter, an example of an intermediate transfer member as a member abutting the electrophotographic photosensitive member, will be described.

The concave/convex portion forming region of the conventionally known electrophotographic photosensitive member having concave/convex portions formed on the surface was provided at least more widely than the region abutting the cleaning blade. Further, when a shape is transferred using a mold member, an end portion of the concave/convex portion forming region in the axial direction of the electrophotographic photosensitive member was a straight line in a circumferential direction of the electrophotographic photosensitive member, along a pattern area of the mold.

That is, a distance L from the central portion to the one end portion of the concave/convex portion forming region in the axial direction of the surface of the electrophotographic photosensitive member was almost the same over the circumferential direction of the electrophotographic photosensitive member.

The cylindrical electrophotographic photosensitive member is in contact with the intermediate transfer member while rotating. When focusing on a point in the axial direction of the electrophotographic photosensitive member, the frictional force is low at a location where there are always concave/convex portions in the circumferential direction and the frictional force is high at a location where there are always no concave/convex portions.

In an apparatus using a conventional electrophotographic photosensitive member, first, an electrophotographic process starts from a state in which the end portion of the intermediate transfer member is more inside than the concave/convex portion forming region. Thereafter, during the use of the apparatus, when the position of the end portion of the intermediate transfer member is deviated to be more outside than the concave/convex portion forming region, the frictional force is greatly increased at an end portion boundary of the concave/convex portion forming region. Therefore, stress concentrates on the end portion of the intermediate transfer member. Equally, even when the position of the end portion of the intermediate transfer member is deviated from the outside to the inside of the concave/convex portion forming region, by repeating these operations, breaks or scratches which cause the surface to peel off occur at the end portion of the intermediate transfer member and a life of the intermediate transfer member is shortened.

On the other hand, in the electrophotographic photosensitive member according to one embodiment of the present invention, a distance L from a central portion to one end portion of the concave/convex portion forming region in the axial direction of the surface of the electrophotographic photosensitive member of the concave/convex portion forming region, is intentionally non-uniform, when viewed in the circumferential direction of the electrophotographic photosensitive member. That is, the distance L from the central portion to one end portion of the concave/convex portion forming region in the axial direction of the surface of the electrophotographic photosensitive member has a maximum value Lmax and a minimum value Lmin.

The axial end portion of the electrophotographic photosensitive member as such has a region in which a portion having the concave/convex portion forming region and a portion having no concave/convex portion forming region are mixed, when viewed in the circumferential direction of the electrophotographic photosensitive member. In the region in which a portion having the concave/convex portion forming region and a portion having no concave/convex portion forming region are mixed, an average frictional force between the electrophotographic photosensitive member and the intermediate transfer member is always a value between an area always having the concave/convex portion and an area always having no concave/convex portion. Therefore, when the intermediate transfer member is deviated in the axial direction, change in the frictional force becomes moderate. Thus, deterioration of the intermediate transfer member can be suppressed.

Hereinafter, the region on the surface of the electrophotographic photosensitive member in which a portion having the concave/convex portion forming region and a portion having no concave/convex portion forming region are mixed is referred to as region A. The region A is described in more detail, as follows. That is, it is a region in the axial end portion of the surface of the electrophotographic photosensitive member, and a region sandwiched between a surface perpendicular to the axial direction of the electrophotographic photosensitive member at an end position of the concave/convex portion forming region where Lmin is measured, and a surface perpendicular to the axial direction of the electrophotographic photosensitive member at an end position of the concave/convex portion forming region where Lmax is measured.

The electrophotographic photosensitive member according to one embodiment of the present invention will be described in more detail, referring to the drawings. FIG. 1 is a drawing illustrating an appearance of an example of an electrophotographic photosensitive member according to one embodiment of the present invention, and as illustrated in FIG. 1, a cylindrical electrophotographic photosensitive member 1 has a cylindrical substrate 2 and a surface layer provided on its surface. Then, a surface of the surface layer is provided with at least one of concave portions and convex portions.

An end portion of the concave/convex portion forming region 3 is not a straight line but a waveform, in a circumferential direction of the electrophotographic photosensitive member. A distance L from the central portion to one end portion of the concave/convex portion forming region in the axial direction of the surface of the electrophotographic photosensitive member has a maximum value Lmax and a minimum value Lmin.

It is preferred that the concave/convex portion forming region 3 has Lmax and Lmin at each of the end portions in the axial direction of the electrophotographic photosensitive member 1. Here, Lmax at both end portions may be different from each other, or Lmin at both end portions may be different from each other.

It is important that the relationship between Lmax and Lmin satisfy the following Expression (1):

$$0.006 \leq (Lmax - Lmin)/Lmax \leq 0.116 \quad \text{Expression (1).}$$

That is, in order to obtain the effect of the present invention, it is necessary to have the region A having a certain or larger area in the axial direction of the surface of the electrophotographic photosensitive member. When (Lmax−Lmin)/Lmax is 0.006 or more, the obtained effect of the present invention can be high. Further, when (Lmax−Lmin)/Lmax is 0.116 or less, the region A does not become unduly wide, and a high effect of providing the concave/convex portion forming region can be obtained. It is more preferred that Lmax and Lmin satisfy the following Relational Expression (2):

$$0.011 \leq (Lmax - Lmin)/Lmax \leq 0.087 \quad \text{Expression (2).}$$

In a more preferred embodiment of the present invention, Lmax, Lmin, and a diameter P of the cross section perpendicular to the axial direction of the electrophotographic photosensitive member satisfy the following Expression (3):

$$0.100 \leq (Lmax - Lmin)/P \leq 0.333 \quad \text{Expression (3).}$$

Expression (3) shows that the larger the diameter of the cross section perpendicular to the axial direction of the electrophotographic photosensitive member is, the wider the region A needs to be. Since the larger the diameter is, the larger the contact area with the intermediate transfer member is, the area of the region A required for the axial deviation of the electrophotographic photosensitive member also increases.

It is preferred that the area of the concave/convex portion forming region in the region A is not too large and not too small considering the role. Specifically, in the region A, when a ratio of the area of the concave/convex portion forming region to the area of the region A is 20% or more and 80% or less, the effect of the present invention is more easily obtained.

Here, determination (definition) and the like of the concave portion, the convex portion, the flat portion, and the like on the surface of the cylindrical electrophotographic photosensitive member according to one embodiment of the present invention will be described.

Figure 2:
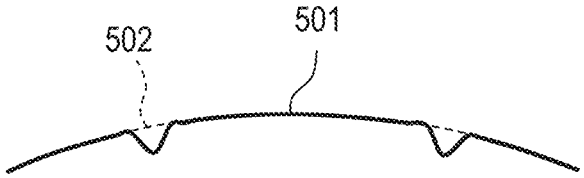
FIG. 2 is a drawing illustrating an example of a fitting of a concave portion on a surface of the electrophotographic photosensitive member according to one embodiment of the present invention.

First, the surface of the cylindrical electrophotographic photosensitive member is enlarged and observed with a microscope. Since the surface (circumferential surface) of the electrophotographic photosensitive member is a curved surface curved in the circumferential direction, a cross section profile of the curved surface is extracted, and the obtained circular arc is fitted. In FIG. 2, an example of a fitting is illustrated. In FIG. 2, a solid line 501 is the cross section profile of the surface (curved surface) of the electrophotographic photosensitive member, and a broken line 502 is a curve fitted to the cross section profile 501. The cross section profile 501 is corrected so that the curve 502 becomes a straight line, and a surface obtained by extending the obtained straight line in a longitudinal direction (a direction orthogonal to the circumferential direction) of the electrophotographic photosensitive member is taken as a reference surface.

A surface parallel to the reference surface, which is 0.2 μm away from the obtained reference surface in a direction toward the center of the cross section of the electrophotographic photosensitive member (lower part of the reference surface) is taken as a second reference surface. Further, a surface parallel to the reference surface, which is 0.2 μm away from the reference surface in a direction opposite to the direction toward the center of the cross section of the electrophotographic photosensitive member (upper part of the reference surface) is taken as a third reference surface.

Figure 3:
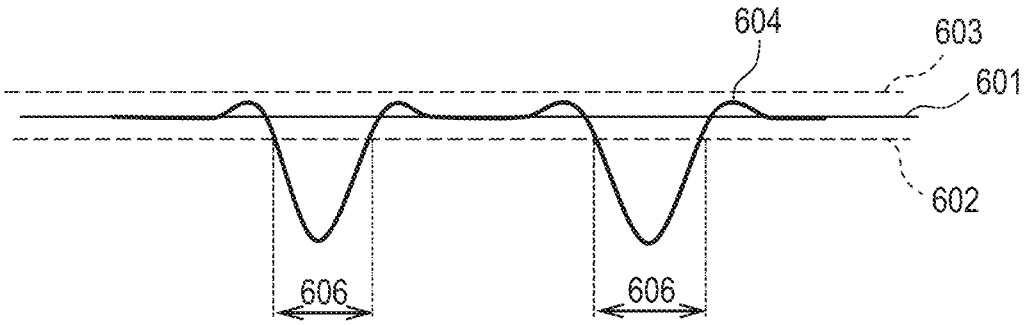
FIG. 3 is a drawing schematically illustrating a relationship among a reference surface, a flat portion, a concave portion, and the like on the surface of the electrophotographic photosensitive member according to one embodiment of the present invention.
Figure 4:
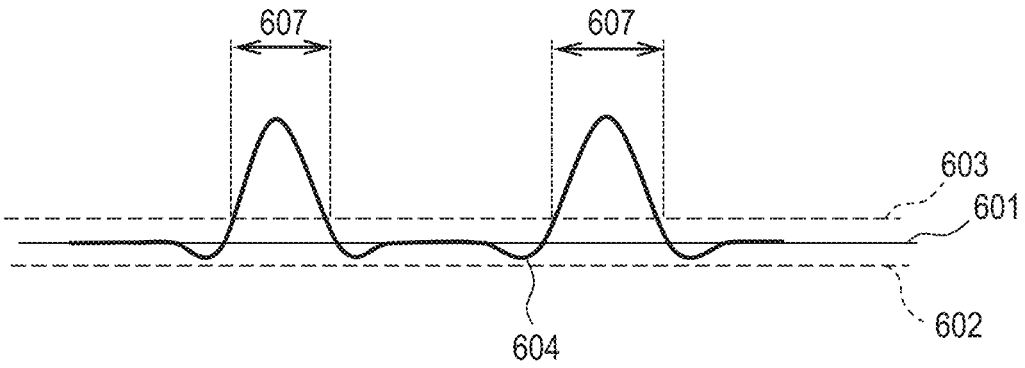
FIG. 4 is a drawing schematically illustrating a relationship among a reference surface, a flat portion, a convex portion, and the like on the surface of the electrophotographic photosensitive member according to one embodiment of the present invention.

FIG. 3 schematically illustrates a relationship among the reference surface 601, the second reference surface 602, the third reference surface 603, the cross section profile 604 after the correction, the concave portion 606, and the like, as an example of determining the concave portion. Further, FIG. 4 schematically illustrates a relationship among the reference surface 601, the second reference surface 602, the third reference surface 603, the cross section profile 604 after the correction, the convex portion 607, and the like, as an example of determining the convex portion.

Here, the flat portion, the convex portion, the concave portion, a depth of the concave portion, an opening portion of the concave portion, an opening area of the concave portion, a height of the convex portion, a lower portion of the convex portion, and a lower portion area of the convex portion are defined, respectively, as follows.

- A portion sandwiched between the second reference surface 602 and the third reference surface 603 is defined as the flat portion.
- A portion which is positioned in a direction away from the central direction of the cross section of the electrophotographic photosensitive member relative to the third reference surface 603 is defined as the convex portion.
- A portion which is positioned in the cylindrical central direction of the cross section of the electrophotographic photosensitive member relative to the second reference surface 602 is defined as the concave portion.
- A distance from the second reference surface 602 to the farthest point toward the central direction of the cross section of the electrophotographic photosensitive member in the concave portion is defined as the depth of the concave portion.

When looking the concave portion down from directly above the surface of the electrophotographic photosensitive member, a line where a recessed portion meets the surrounding flat portion is a line where the second reference surface 602 and the concave portion intersect, and a portion surrounded by the line is defined as the opening portion of the concave portion.

An area of the opening portion of the concave portion is defined as the opening area of the concave portion.

A distance from the third reference surface 603 to the farthest point toward a direction away from the center of the cross section of the electrophotographic photosensitive member in the convex portion is defined as the height of the convex portion.

When looking the convex portion down from directly above the surface of the electrophotographic photosensitive member, a line where a raised portion meets the surrounding flat portion is a line where the third reference surface 603 and the convex portion intersect, and a portion surrounded by the line is defined as the lower portion of the convex portion.

An area of the lower portion of the convex portion is defined as the lower portion area of the convex portion.

Figure 5A:
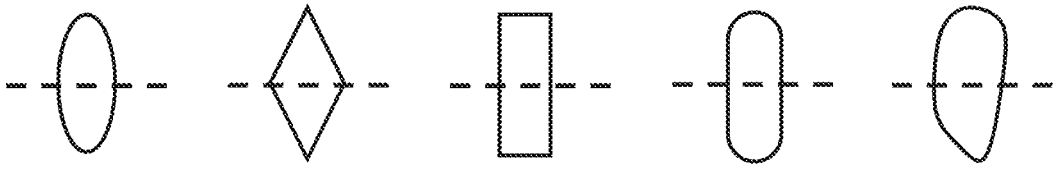
FIGS. 5A and 5B are drawings illustrating an example of a shape of an opening portion of the concave portion or a lower portion of the convex portion and a shape of a cross section, provided on the surface of the electrophotographic photosensitive member according to one embodiment of the present invention.
Figure 5B:
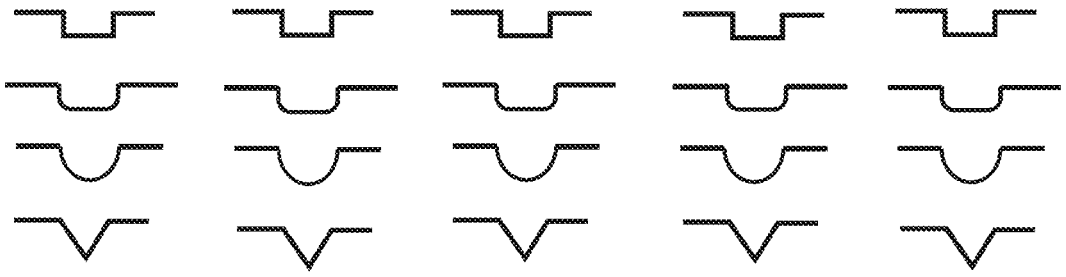

A shape of the concave portion and a shape of the convex portion provided on the surface of the electrophotographic photosensitive member according to one embodiment of the present invention are not particularly limited. As illustrated in FIG. 5A, the shape of the opening portion of the concave portion and the shape of the lower surface of the convex portion may be various, and examples thereof include a circle, an ellipse, a square, a rectangle, a triangle, a pentagon, a hexagon, and the like. Further, as illustrated in FIG. 5B, the cross sectional shape of the concave portion and the convex portion may be various. For example, a shape consisting of a curve such as a substantially semicircular shape, a wave shape consisting of a continuous curve, a shape having edges such as a triangle, a quadrangle, and a polygon, and a shape in which the edges of the triangle, the quadrangle, or the polygon are partially or entirely transformed into a curve are included.

The concave portions and the convex portions provided on the surface of the electrophotographic photosensitive member having different shapes, opening areas, and depths may be mixed. Further, the concave portions and the convex portions may be mixed.

Examples of a method of forming the concave portions and the convex portions on the surface of the electrophotographic photosensitive member include a method of pressure welding a mold member (mold) having convex portions corresponding to concave portions to be formed and the concave portions corresponding to the convex portions to be formed on the surface of the electrophotographic photosensitive member to perform shape transfer.

Figure 6A:
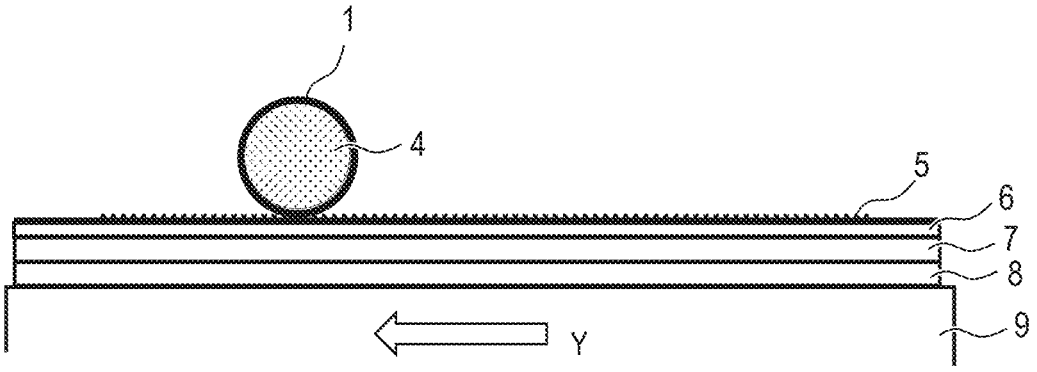
FIGS. 6A and 6B are drawings illustrating an example of a method of forming concave portions on the surface of the electrophotographic photosensitive member according to one embodiment of the present invention.
Figure 6B:
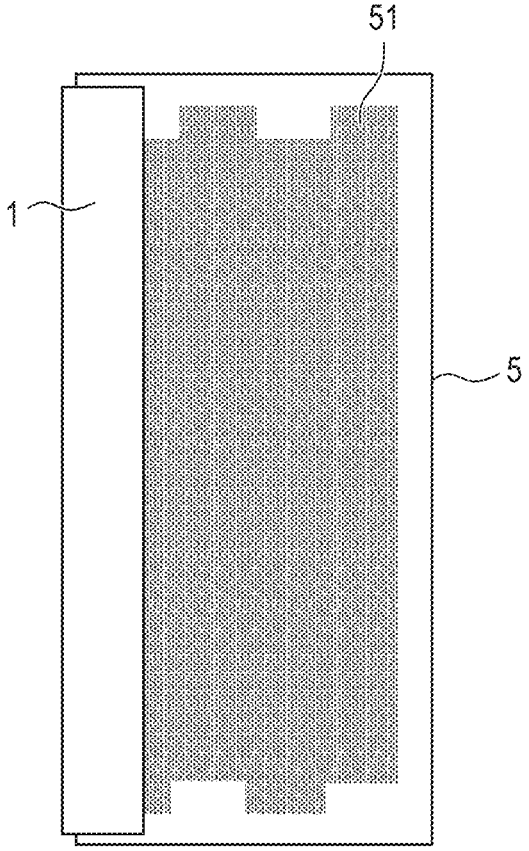
Figure 7A:
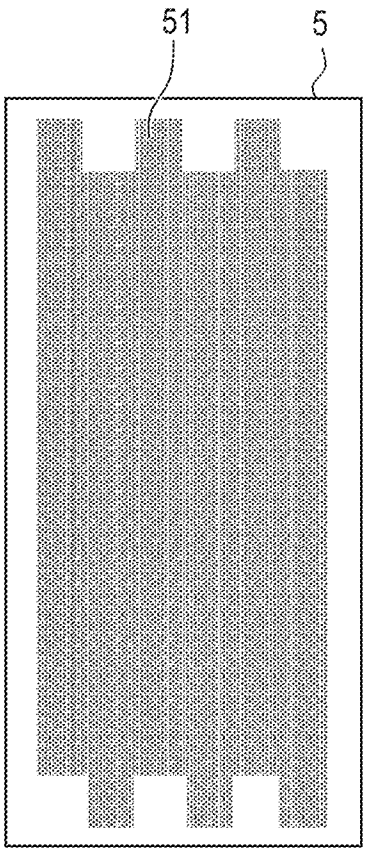
FIGS. 7A, 7B, 7C and 7D are drawings illustrating an example of a mold member for forming at least one of the concave portions and the convex portions on the surface of the electrophotographic photosensitive member according to one embodiment of the present invention.
Figure 7B:
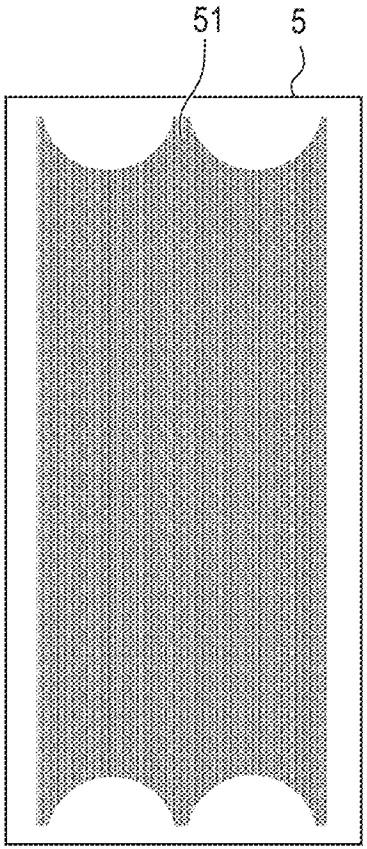
Figure 7C:
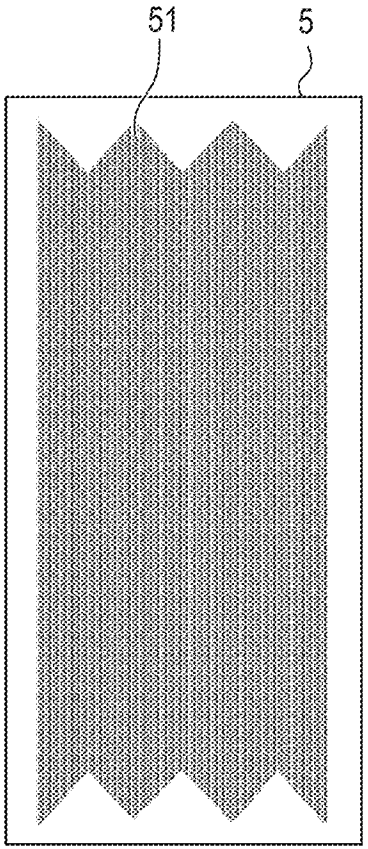
Figure 7D:
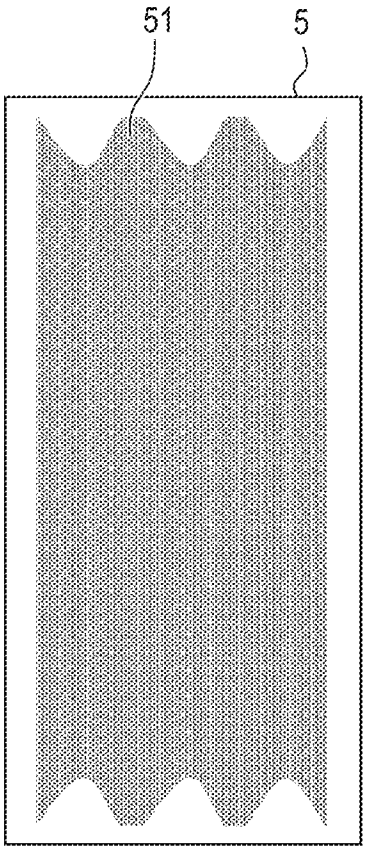

In FIGS. 6A and 6B, an example of pressure welding shape transfer processing equipment for forming the concave portions and the convex portions on the surface of the electrophotographic photosensitive member is illustrated. FIG. 6A is a side view illustrating an outline of pressure welding shape transfer processing equipment, and FIG. 6B is a top view illustrating an outline of pressure welding shape transfer processing equipment.

In the pressure welding shape transfer processing equipment illustrated in FIGS. 6A and 6B, each member is arranged in the order of the mold member 5, a metal layer 6, an elastic layer 7, and a positioning member 8, which is the order from close to the electrophotographic photosensitive member 1 which is an object to be transferred, on a support member 9. An insertion member 4 is inserted to the electrophotographic photosensitive member 1, using the pressure welding shape transfer processing equipment, and a load is applied to the insertion member 4 while the mold member 5 is moved in a Y direction illustrated in FIG. 6A by a sliding mechanism or the like. In this way, the electrophotographic photosensitive member 1 is rotated while the mold member 5 continuously comes into pressure contact with the surface (circumferential surface) of the electrophotographic photosensitive member, whereby the concave portions and the convex portions can be formed on the surface of the electrophotographic photosensitive member 1. It is preferred that the mold member 5 and the electrophotographic photosensitive member 1 are heated, from a viewpoint of performing shape transfer efficiently.

FIGS. 7A to 7D are top views illustrating the mold member 5 for forming at least one of the concave portions and the convex portions on the surface of the electrophotographic photosensitive member.

As the non-uniform shape of the longitudinal end of the mold member as shown, any shape can be used as long as it exhibits a frictional force required for the region A, such as a rectangular wave form, a circular arc shape, a sealer cutting shape, and a wave form, as illustrated in FIGS. 7A to 7D.

Figure 8A:
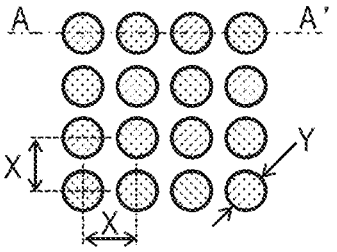
FIGS. 8A, 8B, 8C and 8D are drawings illustrating an example of a mold member for forming at least one of the concave portions and the convex portions on the surface of the electrophotographic photosensitive member according to one embodiment of the present invention.
Figure 8B:
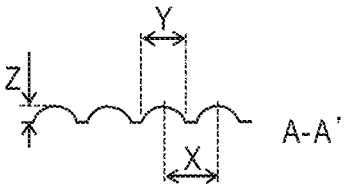
Figure 8C:
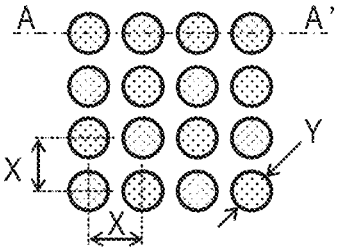
Figure 8D:
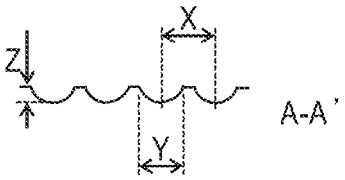

An outline of a convex shape portion and a concave shape portion provided on the mold member is illustrated in FIGS. 8A to 8D. FIGS. 8A and 8C are top views of the convex shape portions and the concave shape portions provided on the mold member, respectively, and FIGS. 8B and 8D are a cross sectional view taken along line A-A' of FIG. 8A and a cross sectional view taken along line A-A' of FIG. 8C, respectively. As illustrated in FIGS. 8A to 8D, hemispherical shapes are continuously provided, and the convex shape portion and the concave shape portion have, for example, a predetermined pitch X, a predetermined diameter of a hemispherical shape Y, and a predetermined height of a hemispherical shape Z.

Examples of the mold member 5 include a fine surface-processed metal or resin film, a silicon wafer having a surface patterned by a resist, a resin film in which fine particles are dispersed, and a resin film having a fine surface shape coated with a metal.

<Configuration of Electrophotographic Photosensitive Member>

The cylindrical electrophotographic photosensitive member according to one embodiment of the present invention includes a support and a photosensitive layer formed on the support.

Examples of the photosensitive layer include a single layer type photosensitive layer containing both a charge transporting substance and a charge generating substance in the same layer, and a laminated (function separating type) photosensitive layer which is separated into a charge generation layer containing a charge generating substance and a charge transport layer containing a charge transporting substance. A laminated photosensitive layer is preferred, from a viewpoint of electrophotographic characteristics. Further, the charge generation layer may have a laminated structure or the charge transport layer may have a laminated structure.

It is preferred that the support exhibits electrical conductivity (electro-conductive support). Examples of materials of the support include metals (alloy) such as iron, copper, gold, silver, aluminum, zinc, titanium, lead, nickel, tin, antimony, indium, chromium, an aluminum alloy, and stainless steel. Further, a metal support or a plastic support having a coat formed by vacuum deposition using aluminum, an aluminum alloy, an indium oxide-tin oxide alloy, or the like, can also be used. Further, a support obtained by impregnating plastic or paper with electro-conductive particles such as carbon black, tin oxide particles, titanium oxide particles, and silver particles, or a support made of an electro-conductive binder resin can be used.

The surface of the support may be subjected to cutting treatment, roughening treatment, alumite treatment, and the like, for suppressing interference fringes by laser light scattering.

An electro-conductive layer may be provided between the support and an undercoat layer described later or the photosensitive layer (charge generation layer or charge transport layer), for suppression of interference fringes by laser light scattering, coating of scratches on the support, and the like.

The electro-conductive layer can be formed by applying a coating solution for an electro-conductive layer obtained by dispersing electro-conductive particles with a binder resin and a solvent to form a coating film, and drying and/or curing the obtained coating film.

Examples of the electro-conductive particles used in the electro-conductive layer include carbon black, acetylene black, particles of metals such as aluminum, nickel, iron, nichrome, copper, zinc, and silver, particles of metal oxides such as zinc oxide, titanium oxide, tin oxide, antimony oxide, indium oxide, bismuth oxide, and ITO, and the like. Further, indium oxide doped with tin, or tin oxide doped with antimony or tantalum may be used.

Examples of the coating solution for an electro-conductive layer include ether-based solvent, alcohol-based solvents, ketone-based solvents, aromatic hydrocarbon-based solvent, and the like. A film thickness of the electro-conductive layer is preferably 0.1 μm or more and 50 μm or less, more preferably 0.5 μm or more and 40 μm or less, and more preferably 1 μm or more and 30 μm or less.

Examples of the binder resin used for the electro-conductive layer include polymers and copolymers of vinyl compounds such as styrene, vinyl acetate, vinyl chloride, acrylic ester, methacrylic ester, vinylidene fluoride, and trifluoroethylene, a polyvinylalcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, an epoxy resin, and an isocyanate resin.

The undercoat layer (intermediate layer) may be provided between the support or the electro-conductive layer and the photosensitive layer (charge generation layer or charge transport layer).

The undercoat layer can be formed by applying a coating solution for an undercoat layer obtained by dissolving the binder resin in a solvent to form a coating film, and drying the obtained coating film.

Examples of the binder resin used for the undercoat layer include a polyvinyl alcohol resin, a poly-N-vinylimidazole, a polyethylene oxide resin, ethyl cellulose, an ethylene-acrylic acid copolymer, casein, a polyamide resin, an N-methoxymethylated 6-nylon resin, a copolymer nylon resin, a phenol resin, a polyurethane resin, an epoxy resin, an acrylic resin, a melamine resin, and a polyester resin.

The undercoat layer may further contain metal oxide particles. Examples thereof include particles containing titanium oxide, zinc oxide, tin oxide, zirconium oxide, and aluminum oxide. Further, the metal oxide particles may be metal oxide particles having a surface treated with a surface treatment agent such as a silane coupling agent.

Examples of the solvent used for the coating solution for an undercoat layer include organic solvents such as alcohol-based solvents, sulfoxide-based solvents, ketone-based solvents, ether-based solvents, ester-based solvents, aliphatic halogenated hydrocarbon solvents, and aromatic compounds. A film thickness of the undercoat layer is preferably 0.05 μm or more and 30 μm or less, and more preferably 1 μm or more and 25 μm or less. The undercoat layer may further contain organic resin fine particles and a leveling agent.

Examples of the charge generating substance used in the photosensitive layer include pyrylium and thiapyrylium dyes, phthalocyanine pigments, anthanthrone pigments, dibenzpyrenequinone pigments, pyranthrone pigments, azo pigments, indigo pigments, quinacridone pigments, asymmetric quinocyanine pigments, quinocyanine pigments, and the like. These charge generating substances may be used alone or in combination of two or more.

Examples of the charge transporting substance used in the photosensitive layer include hydrazone compounds, N, N-dialkylaniline compounds, diphenylamine compounds, triphenylamine compounds, triphenylmethane compounds, pyrazoline compounds, styryl compounds, stilbene compounds, and the like.

When the photosensitive layer is the laminated photosensitive layer, the charge generation layer can be formed by applying a coating solution for a charge generation layer obtained by dispersing the charge generating substance with the binder resin and a solvent to form a coating film, and drying the obtained coating film.

A mass ratio of the charge generating substance and the binder resin is preferably within a range of 1:0.3 to 1:4.

Examples of a dispersion processing method include methods using a homogenizer, ultrasonic dispersion, a ball mill, a vibration ball mill, a sand mill, an attritor, a roll mill, and the like.

The charge transport layer can be formed by applying a coating solution for a charge transport layer obtained by dissolving the charge transporting substance and the binder resin in a solvent to form a coating film, and drying the coating film.

Examples of the binder resin used in the charge generation layer and the charge transport layer include polymers of vinyl compounds, polyvinyl alcohol, polyvinyl acetal, polycarbonate, polyester, polysulfone, polyphenylene oxide, polyurethane, a cellulose resin, a phenol resin, a melamine resin, a silicon resin, an epoxy resin, and the like.

A film thickness of the charge generation layer is preferably 5 μm or less, and more preferably 0.1 μm or more and 2 μm or less.

A film thickness of the charge transport layer is preferably 5 μm or more and 50 μm or less, and more preferably 10 μm or more and 35 μm or less.

Further, a protection layer containing the electro-conductive particles or the charge transporting substance and the binder resin may be provided on the photosensitive layer (the charge transport layer, in the case of a laminated photosensitive layer). The protection layer may further contain an additive such as a lubricant. Further, the resin of the protection layer (binder resin) itself may have electrical conductivity and a charge transporting property, and in this case, the protection layer may not contain the electro-conductive particles or the charge transporting substance other than the resin. Further, the binder resin of the protection layer may be a thermoplastic resin, or may be a curable resin cured by heat, light, radiation (such as electron beam), and the like.

A film thickness of the protection layer is preferably 0.1 μm or more and 30 μm or less, and more preferably 1 μm or more and 10 μm or less.

An additive can be added to each layer of the electrophotographic photosensitive member. Examples of the additive include deterioration inhibitors such as an antioxidant and an ultraviolet ray absorber, fluorine atom-containing resin particles, organic resin particles such as acryl resin particles, inorganic particles such as silica, titanium oxide, and alumina, and the like.

<Configurations of Process Cartridge and Electrophotographic Apparatus>

A process cartridge according to another embodiment of the present invention integrally supports the electrophotographic photosensitive member described above and a cleaning unit having a cleaning blade disposed in contact with the electrophotographic photosensitive member, and is detachably attachable to a main body of the electrophotographic apparatus.

Further, the electrophotographic apparatus according to still another embodiment of the present invention includes the electrophotographic photosensitive member described above, a charging unit, an exposing unit, a developing unit, a transfer unit, and a cleaning unit having a cleaning blade disposed in contact with the electrophotographic photosensitive member.

Figure 9:
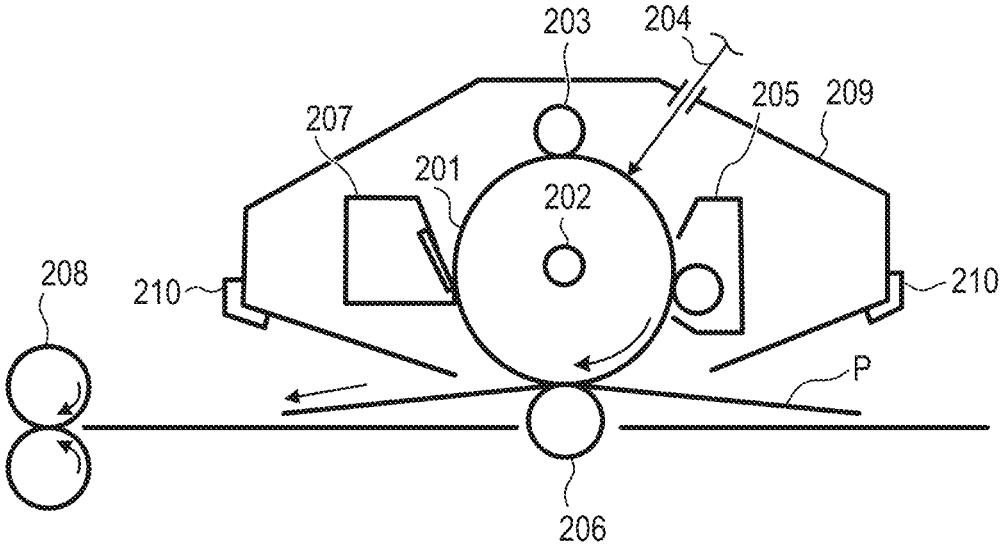
FIG. 9 is a drawing illustrating an example of an electrophotographic apparatus provided with a process cartridge having the electrophotographic photosensitive member according to one embodiment of the present invention.

In FIG. 9, an example of an electrophotographic apparatus provided with a process cartridge having the electrophotographic photosensitive member according to one embodiment of the present invention, is illustrated.

In FIG. 9, a cylindrical electrophotographic photosensitive member 201 of the present invention is driven by rotation having a predetermined circumferential speed (process speed) in an arrow direction around an axis 202. The surface of the electrophotographic photosensitive member 201 is uniformly charged to a predetermined positive or negative potential, by a charging unit 203 (primary charging unit: such as for example, a charging roller), in a rotation process. Next, the uniformly charged surface of the electrophotographic photosensitive member 201 receives exposure light (image exposure light) 204 irradiated from the exposing unit (image exposing unit) (not illustrated). In this way, an electrostatic latent image corresponding to target image information is formed on the surface of the electrophotographic photosensitive member 201.

The present invention is particularly effective when the charging unit using discharge is used.

The electrostatic latent image formed on the surface of the electrophotographic photosensitive member 201 is then developed (normal development or reversal development) with toner in a developing unit 205 to form a toner image. The toner image formed on the surface of the electrophotographic photosensitive member 201 is transferred onto a transfer material P, by a transfer bias from the transfer unit (for example, a transfer roller) 206. At this time, the transfer material P is taken out from the transfer material supply unit (not illustrated) in synchronization with the rotation of the electrophotographic photosensitive member 201 between the electrophotographic photosensitive member 201 and the transfer unit 206 (abutting portion), and fed. Further, a bias voltage having an opposite polarity to a charge retained in the toner is applied from a bias supply (not illustrated) to the transfer unit.

The transfer material P onto which a toner image has been transferred is separated from the surface of the electrophotographic photosensitive member, conveyed to a fixing unit 208, and subjected to toner image fixing, thereby being printed out of the electrophotographic apparatus as an image formed product (print, copy).

The surface of the electrophotographic photosensitive member 201 after the toner image transfer is cleaned by removing deposits such as transfer residual toner by a cleaning unit 207 having a cleaning blade. Also, the cleaning blade is disposed in contact (abutting) with the surface of the electrophotographic photosensitive member 201 in almost the entire area in a generating line direction of the electrophotographic photosensitive member 201. In addition, the cleaned surface of the electrophotographic photosensitive member 201 is subjected to de-electrification by pre-exposure light (not illustrated) from a pre-exposing unit (not illustrated), and then is used for repeated image formation. In addition, as illustrated in FIG. 9, when the charging unit 203 is a contact charging unit using a charging roller or the like, the pre-exposing unit is not always needed. In the present invention, since the above specific electrophotographic photosensitive member 201 is used, a frictional force between the surface of the electrophotographic photosensitive member and the cleaning blade is reduced and wear of a tip of the cleaning blade is suppressed, whereby good cleaning characteristics can be maintained over a long period of time.

In the present invention, among the components selected from the electrophotographic photosensitive member 201, the charging unit 203, the developing unit 205, the transfer unit 206, the cleaning unit 207, and the like, components are housed in a container and integrally supported as a process cartridge 209. Then, the process cartridge 209 can be configured to be detachably attachable to the main body of the electrophotographic apparatus such as a copying machine or a laser beam printer. In FIG. 9, the electrophotographic photosensitive member 201, the charging unit 203, the developing unit 205, and the cleaning unit 207 are integrally supported to form a cartridge. Further, it is used as the process cartridge 209 detachably attachable to the main body of the electrophotographic apparatus using a guiding unit 210 such as a rail of the main body of the electrophotographic apparatus.

When the electrophotographic apparatus is a copying machine or a printer, the exposure light 204 is reflected light or transmitted light from a copy. Alternatively, the exposure light is light irradiated by reading a copy with a sensor, converting it into a signal, scanning a laser beam according to the signal, driving LED array and liquid crystal shutter array, and the like.

According to the present invention, there is provided an electrophotographic photosensitive member which can suppress a large change in a frictional force between the surface of the electrophotographic photosensitive member and the abutting member, and can maintain a long life of the member abutting the electrophotographic photosensitive member.

Hereinafter, the present invention will be described in more detail referring to the specific examples. In the examples, "part" means "parts by mass". In addition, the electrophotographic photosensitive member is hereinafter simply referred to as a "photosensitive member".

(Preparation Example of Photosensitive Member)

An aluminum cylinder having a diameter of 30.0 mm and a length of 357.5 mm was used as a cylindrical substrate 2 (cylindrical support).

Next, 100 parts of zinc oxide particles (specific surface area: 19 $m^2/g$, powder resistance: $4.7\times10^6$ Ω·cm) as a metal oxide were stirred and mixed with 500 parts of toluene. 0.8 parts of a silane coupling agent (compound name: N-2-(aminoethyl)-3-aminopropylmethyldimethoxysilane, trade name: KBM602, manufactured by Shin-Etsu Chemical Co., Ltd.) was added thereto, and the mixture was stirred for 6 hours. Thereafter, toluene was distilled off under reduced pressure, and the resultant was heated and dried at 130° C. for 6 hours to obtain surface-treated zinc oxide particles.

Hereinafter, the following materials were prepared.

15 parts of a butyral resin (trade name: BM-1, manufactured by SEKISUI CHEMICAL CO., LTD.) as a polyol resin 15 parts of blocked isocyanate (trade name: Sumidur 3175, manufactured by Sumika Bayer Urethane Co., Ltd.)

These were dissolved in a mixed solution of 73.5 parts of methyl ethyl ketone and 73.5 parts of 1-butanol. To this solution, 80.8 parts of the surface-treated zinc oxide particles and 0.8 parts of 2,3,4-trihydroxybenzophenone (manufactured by Tokyo Chemical Industry Co., Ltd.) were added, and this was dispersed for 3 hours under an atmosphere of 23±3.0° C. in sand mill equipment using glass beads having a diameter of 0.8 mm. After dispersion, the following materials were added and stirred to prepare a coating solution for an undercoat layer.

0.01 parts of silicone oil (trade name: SH28PA, manufactured by Toray Dow Corning Silicone Co., Ltd.)

5.6 parts of crosslinked polymethyl methacrylate (PMMA) particles (trade name: TECHPOLYMER SSX-102, manufactured by SEKISUI PLASTICS CO., LTD., average primary particle diameter of 2.5 μm)

This coating solution for an undercoat layer was dip-coated on the cylindrical substrate 2, and the resulting coating film was dried at 160° C. for 40 minutes to form the undercoat layer having a film thickness of 18 μm.

Hereinafter, the following materials were prepared.

20 parts of hydroxygallium phthalocyanine crystal (charge generating substance) of a crystal form having strong peaks at 7.4° and 28.2° with a Bragg angle of 2θ±0.2° in CuKα characteristic X-ray diffraction 0.2 parts of a calixarene compound represented by the following Structural Formula (A)

10 parts of a polyvinyl butyral (trade name: S-LEC BX-1, manufactured by SEKISUI CHEMICAL CO., LTD.)/ 600 parts of cyclohexanone These were placed in a sand mill using glass beads having a diameter of 1 mm and dispersed for 4 hours, and 700 parts of ethyl acetate was added to prepare a coating solution for a charge generation layer. The coating solution for a charge generation layer was dip-coated on the undercoat layer and the resulting coating film was dried at 80° C. for 15 minutes to form the charge generation layer having a film thickness of 0.17 μm.

Hereinafter, the following materials were prepared.

30 parts of a compound (charge transporting substance) represented by the following Structural Formula (B)

60 parts of a compound (charge transporting substance) represented by the following Structural Formula (C)

10 parts of a compound (charge transporting substance) represented by the following Structural Formula (D)

100 parts of a polycarbonate resin (trade name: Iupilon Z400, manufactured by Mitsubishi Engineering-Plastics Corporation, bisphenol Z type polycarbonate)

0.02 parts of polycarbonate (viscosity average molecular weight Mv: 20000) represented by the following Structural Formula (E)

These were dissolved in a mixed solvent of 600 parts of mixed xylene and 200 parts of dimethoxymethane to prepare a coating solution for a charge transport layer. The coating solution for a charge transport layer was dip-coated on the charge generation layer to form a coating film, and the resulting coating film was dried at 100° C. for 30 minutes to form the charge transport layer having a film thickness of 18

(B)

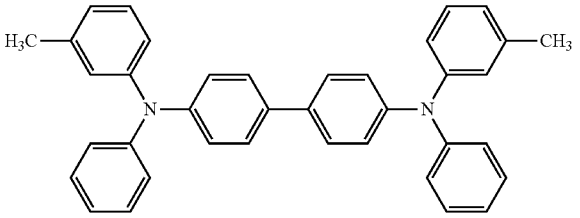

(C)

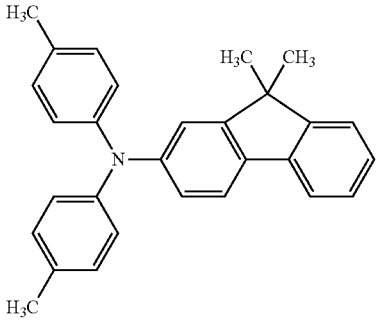

(A)

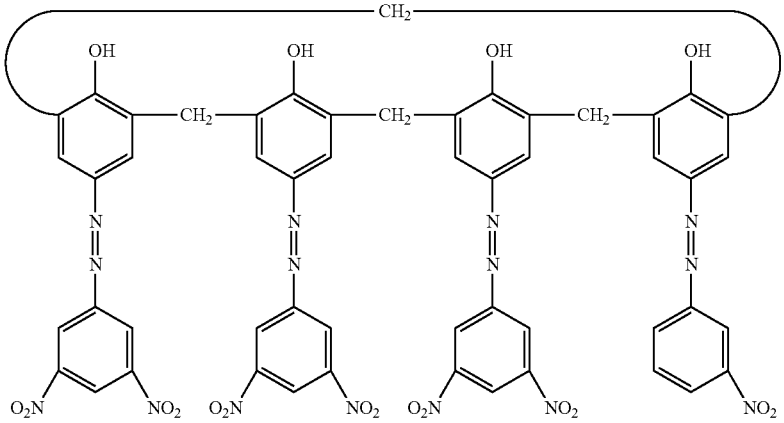

-continued (D)

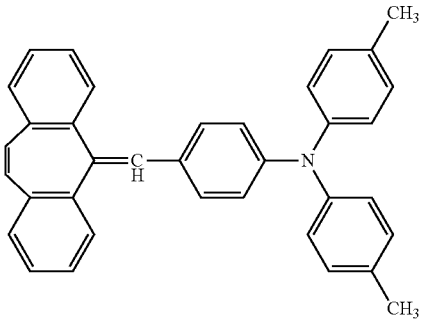

(E)

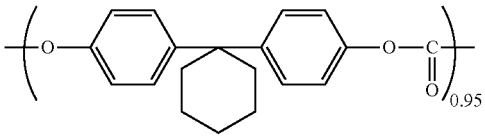

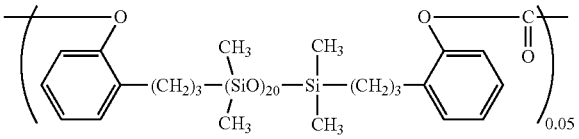

(In Formula (E), 0.95 and 0.05 are molar ratios (copolymerization ratios) of two structural units.)

Next, a mixed solvent of 20 parts of 1,1,2,2,3,3,4-heptafluorocyclopentane (trade name: ZEORORA H, manufactured by Zeon Corporation)/20 parts of 1-propanol was filtered. A polyflon filter (trade name: PF-040, manufactured by Advantec Toyo Kaisha, Ltd.) was used. Thereafter, 90 parts of a hole transporting compound (charge transporting substance) represented by the following Structural Formula (F), 70 parts of 1,1,2,2,3,3,4-heptafluorocyclopentane, and 70 parts of 1-propanol were added to the mixed solvent. This was filtered through a polyflon filter (trade name: PF-020, manufactured by Advantec Toyo Kaisha, Ltd.), thereby preparing a coating solution for a second charge transport layer (protection layer). The coating solution for a second charge transport layer was dip-coated on the charge transport layer, and the resulting coating film was dried at 50° C. for 6 minutes in the air. Thereafter, in nitrogen, while a support (body to be irradiated) was rotated at 200 rpm, the coating film was irradiated with an electron beam for 1.6 seconds under the conditions of an acceleration voltage of 70 kV and an absorbed dose of 8000 Gy. Subsequently, the temperature was raised from 25° C. to 125° C. for 30 seconds in nitrogen to heat the coating film. An oxygen concentration of the atmosphere during electron beam irradiation and subsequent heating was 15 ppm. Next, a heat treatment was performed at 100° C. for 30 minutes in the air, thereby forming the second charge transport layer (protection layer) having a film thickness of 5 μm which was cured by an electron beam.

(F)

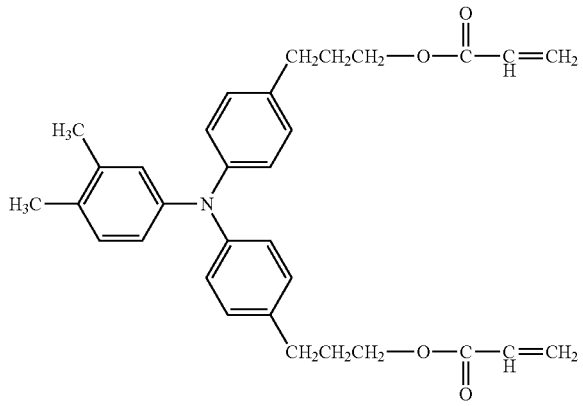

In addition, a lower end portion in an application pulling-up direction of the coating film of all layers applied in the production of the present example was subjected to peeling processing using a solvent at the end of each application process. Then, an application area of all layers was set to be 1 mm from the upper end portion and 1 mm from the lower end portion of the cylindrical substrate 2 in the application pulling-up direction.

In this way, the cylindrical electrophotographic photosensitive member before forming a shape of the surface (electrophotographic photosensitive member before shape formation) was manufactured.

Example 1

(Surface Processing)

An insertion member 4 was inserted into the cylindrical electrophotographic photosensitive member 1 obtained as described above, in a state of being previously heated to 55° C., as illustrated in FIG. 6A. When inserted, the insertion member was inserted so that the center position in the axial core direction of the electrophotographic photosensitive member 1 coincides with the center position in the axial core direction of the insertion member 4. As the materials of the insertion member, a cemented carbide alloy having tungsten carbide as the main material with a modulus of longitudinal elasticity of $540\times10^3$ N/mm$^2$ was used.

Each member was arranged in the order of the mold member 5, a metal layer 6, an elastic layer 7, and a positioning member 8, which is the order from close to the electrophotographic photosensitive member 1 which is an object to be transferred, on a support member 9. The material of the support member 9 was made of SUS 430 and a heater for heating was provided inside. Further, the support member 9 was provided with a slide mechanism moving in a Y direction of FIG. 6A. A positioning member 8 was used by performing electroless nickel plating on a surface of a plate made of SS400 having a thickness of 6 mm. As an elastic layer 7, a silicon rubber having a thickness of 8 mm was used. As a metal layer 6, a flat plate made of SUS 301CSP-3/4H having a thickness of 2 mm was used.

Figure 10C:
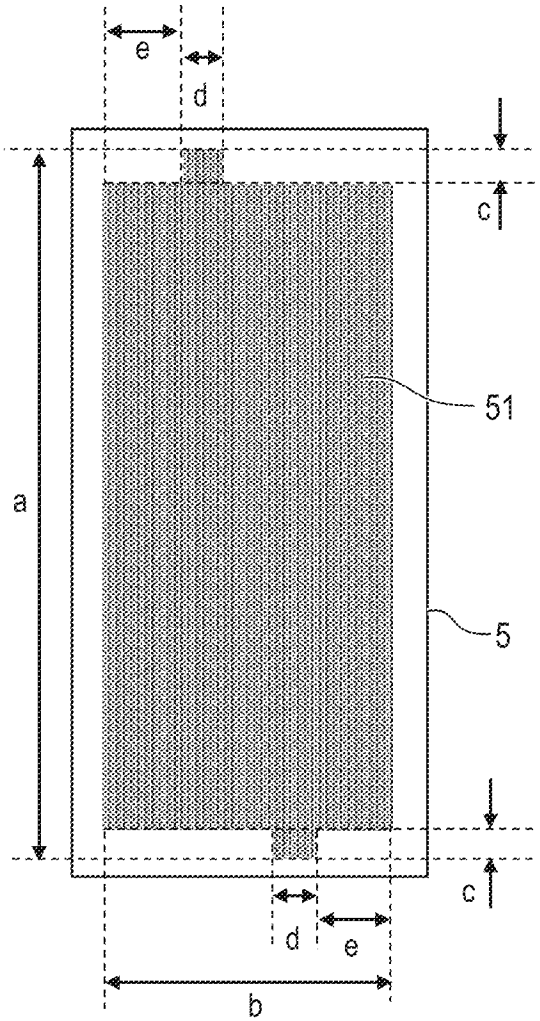
FIGS. 10A, 10B and 10C are drawings illustrating an example of a mold member for forming at least one of the concave portions and the convex portions on the surface of the electrophotographic photosensitive member according to one embodiment of the present invention.
Figure 10B:
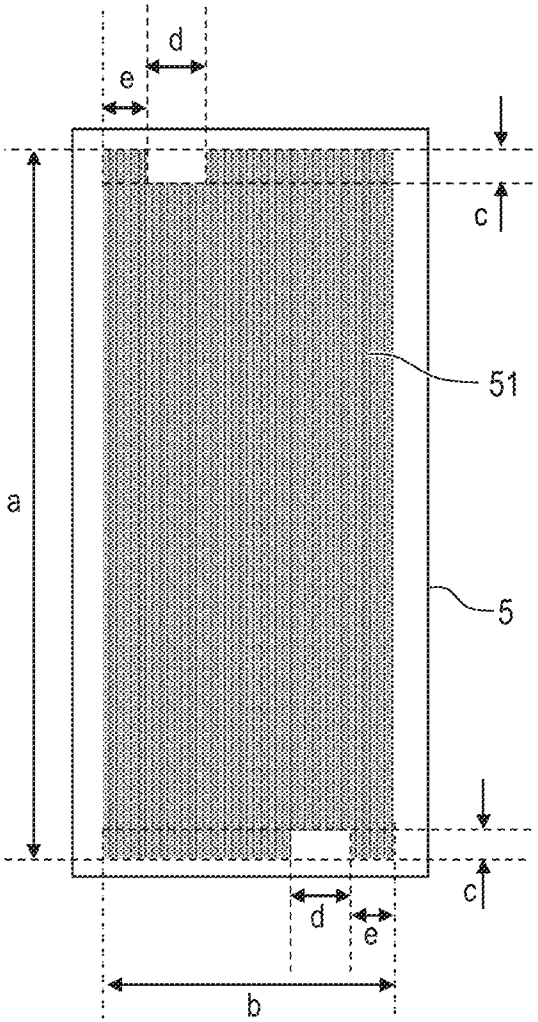
Figure 10A:
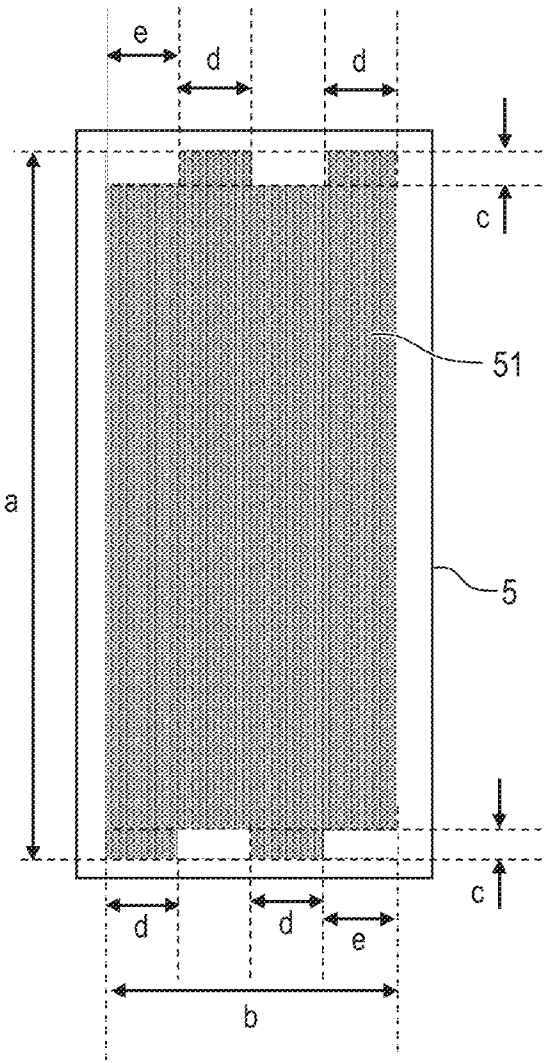

As the type of mold member 5, a flat plate mold made of nickel having a thickness of 300 μm, which has a shape as illustrated in FIG. 10A was used. Then, the mold member 5 was used by allotting the longitudinal direction as shown to the axial direction of the electrophotographic photosensitive member, and each dimension of a convex shape portion forming region 51 which is a region in which a convex shape portion for forming a concave portion is formed on the surface of the photosensitive member, on the surface on which the mold member 5 is in contact with the photosensitive member, was as follows. The length of line segment a was 348 mm, the length of line segment b was 94 mm, the length of line segment c was 7 mm, the length of line segment d was 23.5 mm, and the length of line segment e was 23.5 mm.

On the surface of the convex shape portion forming region 51, the convex shape portion of a convex hemispherical shape as illustrated in FIGS. 8A and 8B over the entire surface was provided. The pitch X of all hemispherical shapes in the convex shape portion forming region 51 was 57 μm. Then, the diameter Y of all hemispherical shapes in the convex shape portion forming region 51 was 50 μm and the height Z thereof was 2.5 μm.

The mold member 5, the metal layer 6, the elastic layer 7, the positioning member 8, and the support member 9 were fixed in the positional relationship illustrated in FIG. 6A. In addition, the mold member 5 was fixed in a direction in which the left side illustrated in FIG. 10A was the left side illustrated in FIGS. 6A and 6B. Further, the mold member 5 was positioned with reference to the center in the axial direction of the electrophotographic photosensitive member 1 of FIG. 6B. Then, the temperature of a heater of the support member 9 in a state in which the upper surface is mounted to be substantially horizontal was raised, and the surface of the mold member 5 was heated to 150° C.

In order to press the surface of the electrophotographic photosensitive member 1 against the mold member 5, a load mechanism (not illustrated) was provided at both end portions of the insertion member 4. Each load mechanism was provided with a guide rail and a ball screw in a vertical direction, and further provided with a connection support member which is connected to the ball screw and the guide rail to move up and down. A servo motor was connected to a lower side of the ball screw and rotated to move the connection support member up and down following the guide rail. The end portions of the connection support member and the insertion member 4 were connected by a spherical joint. In addition, the spherical joint and the connection support member were connected via a load cell, so that each load amount applied to both ends of the insertion member 4 can be monitored.

As processing on the surface of the electrophotographic photosensitive member 1, the electrophotographic photosensitive member 1 was pressed against the mold member 5 using the load mechanism, and the mold member 5 was moved in the Y direction illustrated in FIG. 6A with the slide mechanism. As a result, the shape of the mold member 5 was transferred to the surface of the electrophotographic photosensitive member 1, while the electrophotographic photosensitive member 1 was rolled.

During the processing, first, the position of the support member 9 was adjusted, so that the left end portion in FIGS. 6A and 6B of the convex shape portion forming region 51 of the mold member 5 was directly under the electrophotographic photosensitive member 1. Next, the servo motor of the load mechanism was rotated to move the insertion member 4 in a direction of the mold member 5 at a speed of 20 mm/sec (Vz1). Thereafter, the electrophotographic photosensitive member 1 was brought into contact with the mold member 5, and further, when it was detected that the load amount applied to the insertion member 4 reached 6000 N by the load cell, the movement of the load mechanism was stopped.

Next, the support member 9 was started to move in the Y direction in FIG. 6A at a speed of 10 mm/sec, and the electrophotographic photosensitive member 1 was driven to rotate clockwise in FIG. 6A. In this way, the shape of the convex shape portion on the surface of the mold member 5 was transferred to the surface of the electrophotographic photosensitive member 1.

Then, the slide mechanism was stopped when it has moved 94 mm while maintaining this state, and then the insertion member 4 was moved by the load mechanism in a direction separated from the mold member 5 at a speed of 20 mm/sec, thereby separating the electrophotographic photosensitive member 1 and the mold member 5.

As described above, the shape of the convex shape portion on the surface of the mold member 5 was transferred to the surface of the electrophotographic photosensitive member 1, while the electrophotographic photosensitive member 1 was rolled, whereby the concave portion corresponding to the convex shape portion on the surface of the mold member 5 was formed on the surface of the electrophotographic photosensitive member 1. By the above method, the electrophotographic photosensitive member according to Example 1 having concave portions formed on the surface was manufactured.

(Measurement of Processing Results)

Subsequently, for the concave/convex portion forming region formed on the surface of the electrophotographic photosensitive member processed as such, a distance L from a central portion on the surface of the electrophotographic photosensitive member in the axial direction to one end portion of the concave/convex portion forming region was measured. The measurement method will be described below.

The surface of the resulting electrophotographic photosensitive member was magnification-observed by 10× lens with a laser microscope (manufactured by KEYENCE CORPORATION, trade name: VK-9500), and the concave/convex portion forming region provided on the surface of the electrophotographic photosensitive member was determined. At the time of observation, adjustment was performed so that there is no inclination in a longitudinal direction of the electrophotographic photosensitive member and in the circumferential direction, the top of the arc of the electrophotographic photosensitive member is focused on.

The distance L from the central portion to one end portion of the concave/convex portion forming region in the axial direction of the surface of the electrophotographic photosensitive member was measured over the circumferential direction to obtain a maximum value Lmax and a minimum value Lmin. From these values, the values of (Lmax−Lmin)/Lmax and (Lmax−Lmin)/P were calculated. The results are shown in Table 2. Further, Table 2 shows the results of measuring the area ratio of the concave/convex portion forming region in the region A.

In addition, the surface of the electrophotographic photosensitive member was observed in the same manner as described above using another laser microscope (manufactured by KEYENCE CORPORATION, trade name: X-200), and as a result, the same results as those when the laser microscope (manufactured by KEYENCE CORPORATION, trade name: VK-9500) was used, were obtained. In the following examples, the laser microscope (manufactured by KEYENCE CORPORATION, trade name: VK-9500) and a 10× lens were used for observation of the surface of the electrophotographic photosensitive member.

(Evaluation)

The electrophotographic photosensitive member manufactured in Example 1 was mounted on a modified machine of an electrophotographic copying machine (iR-ADV C5560 manufactured by Canon Inc.), and evaluation was made on occurrence of scratches on the surface of the end portion of the intermediate transfer member and a degree of toner contamination on the electrophotographic photosensitive member.

The electrophotographic photosensitive member was mounted on the drum cartridge for the electrophotographic copying machine.

As the intermediate transfer member, the intermediate transfer member mounted on the drum cartridge for the electrophotographic copying machine (intermediate transfer member provided with a surface layer on a base layer) was used as it was.

For the evaluation, 100,000 sheets of images having an image ratio of 1% were continuously formed under the circumstance of 25° C./50% RH. In addition, in the image formation, control to correct the position of the intermediate transfer member during travel drive was performed to make correction within a range of 5 mm or less left and right from the center position in the width direction.

The end portion of the intermediate transfer member was observed after 100,000 sheets of paper were passed, and evaluated according to the following criteria. In the evaluation ranks, A is the best and E is the worst.

A: no scratches due to movement toward the surface layer of the end portion of the intermediate transfer member are confirmed.

B: minor scratches due to movement toward the surface layer of the end portion of the intermediate transfer member are confirmed.

C: moderate scratches due to movement toward the surface layer of the end portion of the intermediate transfer member are confirmed.

D: broken marks due to movement toward the surface layer of the end portion of the intermediate transfer member are seen, but the surface layer has not been peeled off or broken.

E: peeling off/breaks of the surface layer due to movement toward the surface layer of the end portion of the intermediate transfer member are seen.

Further, the degree of toner contamination on the electrophotographic photosensitive member after 100,000 sheets of paper were passed was evaluated according to the following criteria. In the evaluation ranks, A is the best and D is the worst.

A: toner contamination of the surface of the electrophotographic photosensitive member around the area in contact with the end portion of the cleaning blade is equivalent to that of the central portion.

B: toner contamination of the surface of the electrophotographic photosensitive member around the area in contact with the end portion of the cleaning blade is slightly higher than that of the central portion.

C: toner contamination of the surface of the electrophotographic photosensitive member around the area in contact with the end portion of the cleaning blade is higher than that of the central portion, but the area is outside the width of the passing paper.

D: toner contamination of the surface of the electrophotographic photosensitive member around the area in contact with the end portion of the cleaning blade is higher than that of the central portion, and the area extends to the inside of the width of the passing paper.

The evaluation results are shown in the following Table 2.

Examples 2 to 13 and Comparative Examples 1 to 3

In Example 1, the types of mold members and the dimensions of the mold members were changed as shown in Table 1. Other than that, the electrophotographic photosensitive members according to Examples 2 to 13 and Comparative Examples 1 to 3 were manufactured in the same manner as in Example 1. Further, in the resulting electrophotographic photosensitive member, measurement and evaluation were performed in the same manner as in Example 1. The results are shown in Table 2.

In addition, the type of mold members illustrated in FIGS. 10B and 10C are the same as the type of mold members as illustrated in FIG. 10A, except that the shape of the convex shape portion forming region 51 is different.

Examples 14 to 17

In Example 1, an aluminum cylinder having a diameter of 30.6 mm and a length of 357.5 mm was used as a cylindrical substrate 2 (cylindrical support). Further, the types of mold members and the dimensions of the mold members were changed as shown in Table 1. Other than that, the electrophotographic photosensitive members according to Examples 14 to 17 were manufactured in the same manner as in Example 1. Further, in the resulting electrophotographic photosensitive member, measurement and evaluation were performed in the same manner as in Example 1. The results are shown in Table 2.

Example 18

Figure 12:
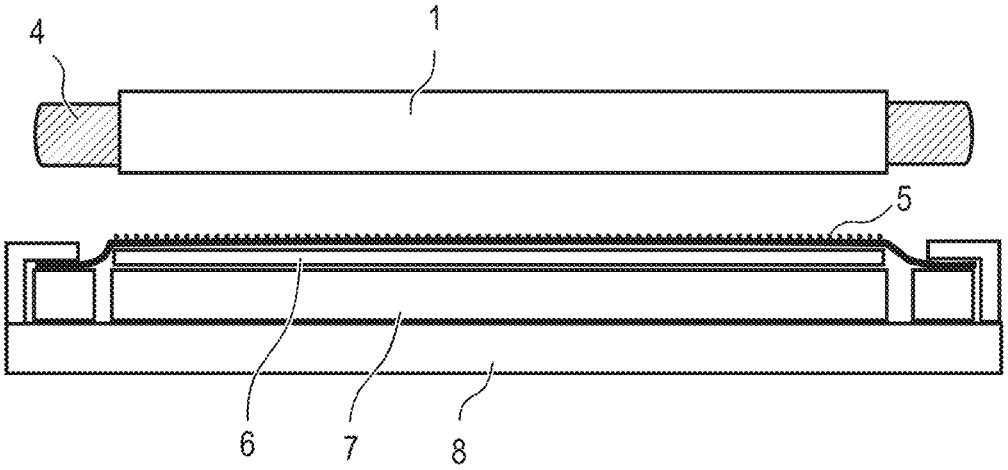
FIG. 12 is a drawing illustrating an example of a method of forming concave portions on the surface of the electrophotographic photosensitive member according to one embodiment of the present invention.

In Example 1, a mold unit illustrated in FIG. 12 was used at the time of surface processing.

Differences between the mold unit used in Example 1 and the mold unit illustrated in FIG. 12 are that a thickness of the elastic layer 7 is 10 mm and the central portion and the end portion of the mold member 5 are arranged at different heights. As the type of the mold member 5, the mold member illustrated in FIG. 11 was used.

Figure 11:
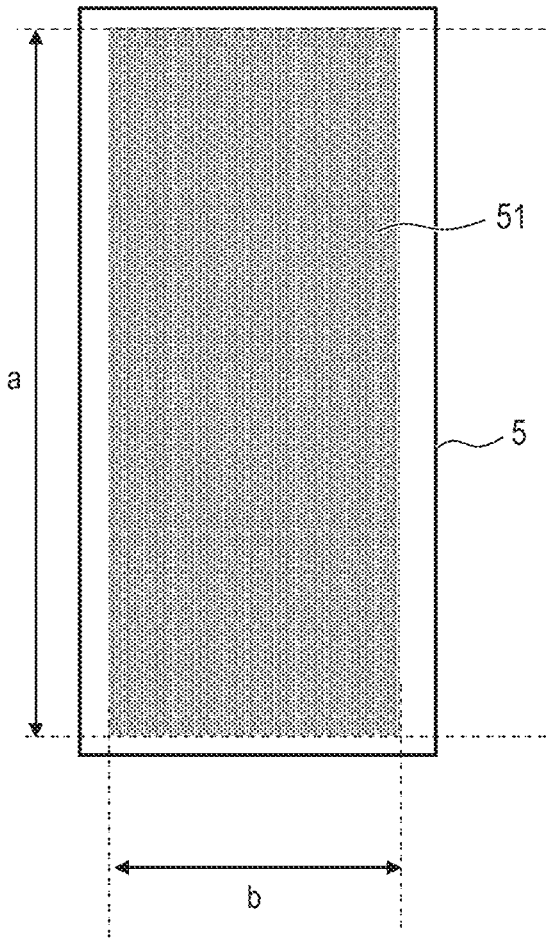
FIG. 11 is a drawing illustrating an example of a mold member for forming at least one of the concave portions and the convex portions on the surface of the electrophotographic photosensitive member according to one embodiment of the present invention.

During the surface processing, first, the position of the support member 9 was adjusted, so that the left end portion in FIG. 11 of the convex shape portion forming region 51 of the mold member 5 was directly under the electrophotographic photosensitive member 1. Next, the servo motor of the same load mechanism as that used in Example 1 was rotated to move the insertion member 4 in the direction of the mold member 5 at a speed of 20 mm/sec (Vz1). Thereafter, the electrophotographic photosensitive member 1 was brought into contact with the mold member 5, and further, when it was detected that the load amount applied to the insertion member 4 reached 6000 N by the load cell, the movement of the load mechanism was stopped.

Next, the support member 9 was started to move in the Y direction in FIG. 6A at a speed of 10 mm/sec, and the electrophotographic photosensitive member 1 was driven to rotate clockwise in FIG. 6A. In this way, the convex portion on the surface of the mold member 5 was transferred to the surface of the electrophotographic photosensitive member 1.

Here, the slide mechanism was temporarily stopped when it moved 47 mm while maintaining a state of a load amount of 6000 N, and the load mechanism was operated so that the load amount applied to the insertion member 4 by the load cell is 2000 N. Subsequently, the slide mechanism was further stopped when it moved 47 mm while maintaining a state of a load amount of 2000 N. Thereafter, the insertion member 4 was moved by the load mechanism in a direction separated from the mold member 5 at a speed of 20 mm/sec, thereby separating the electrophotographic photosensitive member 1 and the mold member 5.

Figure 13:
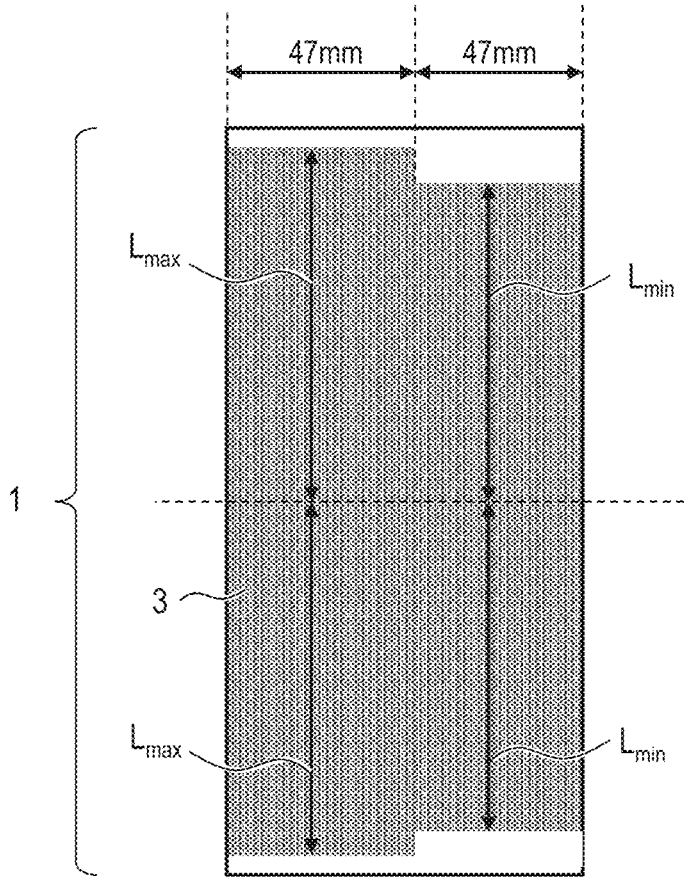
FIG. 13 is a development elevation illustrating an example of the surface of the electrophotographic photosensitive member according to one embodiment of the present invention.

The development elevation of the surface of the electrophotographic photosensitive member processed as such is illustrated in FIG. 13. The electrophotographic photosensitive member according to Example 18 was formed with the concave/convex portion forming region having Lmax in the range processed at 6000 N and the concave/convex portion forming region having Lmin in the range processed at 2000 N.

The resulting electrophotographic photosensitive member, measurement and evaluation were performed in the same manner as in Example 1. The evaluation results are shown in the following Table 2.

TABLE 1

| | Type of mold members | Line segment a [mm] | Line segment b [mm] | Line segment c [mm] | Line segment d [mm] | Line segment e [mm] |
|---|---|---|---|---|---|---|
| Example 1 | FIG. 10A | 348 | 94 | 7 | 23.5 | 23.5 |
| Example 2 | FIG. 10B | 348 | 94 | 7 | 18.8 | 18.8 |
| Example 3 | FIG. 10C | 348 | 94 | 7 | 18.8 | 18.8 |
| Example 4 | FIG. 10B | 348 | 94 | 10 | 9.4 | 9.4 |
| Example 5 | FIG. 10C | 348 | 94 | 3 | 9.4 | 9.4 |
| Example 6 | FIG. 10B | 348 | 94 | 15 | 9.4 | 9.4 |
| Example 7 | FIG. 10C | 348 | 94 | 2 | 9.4 | 9.4 |
| Example 8 | FIG. 10B | 348 | 94 | 20 | 9.4 | 9.4 |
| Example 9 | FIG. 10C | 348 | 94 | 1 | 9.4 | 9.4 |
| Example 10 | FIG. 10A | 340 | 94 | 7 | 23.5 | 23.5 |
| Example 11 | FIG. 10C | 340 | 94 | 1 | 9.4 | 9.4 |
| Example 12 | FIG. 10A | 348 | 94 | 1 | 23.5 | 23.5 |
| Example 13 | FIG. 10A | 348 | 94 | 16 | 23.5 | 23.5 |
| Example 14 | FIG. 10C | 348 | 94 | 3.1 | 9.4 | 9.4 |
| Example 15 | FIG. 10B | 348 | 94 | 10.2 | 9.4 | 9.4 |
| Example 16 | FIG. 10C | 348 | 94 | 3 | 9.4 | 9.4 |
| Example 17 | FIG. 10B | 348 | 94 | 11 | 9.4 | 9.4 |
| Example 18 | FIG. 11 | 348 | 94 | — | — | — |
| Comparative Example 1 | FIG. 11 | 348 | 94 | — | — | — |
| Comparative Example 2 | FIG. 10A | 348 | 94 | 0.5 | 23.5 | 23.5 |
| Comparative Example 3 | FIG. 10A | 348 | 94 | 22 | 23.5 | 23.5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-215801, filed Nov. 16, 2018, which is hereby incorporated by reference herein in its entirety.

What is claimed is:

1. A cylindrical electrophotographic photosensitive member, comprising:

a concave/convex portion forming region in which at least one of concave portions and convex portions are formed on a surface of the electrophotographic photosensitive member from a central portion to both end portions in an axial direction of the electrophotographic photosensitive member, wherein $$0.011 \leq (Lmax - Lmin)/Lmax \leq 0.087 \text{ and } 0.100 \leq (Lmax - Lmin)/P \leq 0.333$$

where Lmax and Lmin are respectively maximum and minimum values of a distance L from the central portion to one end portion of the concave/convex portion forming region in the axial direction of the surface of the electrophotographic photosensitive member, and P is a diameter of the electrophotographic photosensitive member, and a ratio of an area of the concave/convex portion forming region to an area of region A is 20 to 80% where region A is a region in an axial end portion of the surface of the electrophotographic photosensitive member that is sandwiched between a surface perpendicular to the axial direction of the electrophotographic photosensitive member at an end position of the concave/convex portion forming region where Lmin is measured, and a surface perpendicular to the axial direction of the

TABLE 2

| | Lmax [mm] | Lmin [mm] | P [mm] | (Lmax − Lmin)/Lmax | (Lmax − Lmin)/P | Area ratio of concave/convex portion of region A [%] | Scratches of end portion of intermediate transfer member | Toner contamination on surface of photosensitive member |
|---|---|---|---|---|---|---|---|---|
| Example 1 | 174 | 167 | 30 | 0.040 | 0.233 | 50 | A | A |
| Example 2 | 174 | 167 | 30 | 0.040 | 0.233 | 80 | A | A |
| Example 3 | 174 | 167 | 30 | 0.040 | 0.233 | 20 | A | A |
| Example 4 | 174 | 164 | 30 | 0.057 | 0.333 | 90 | B | A |
| Example 5 | 174 | 171 | 30 | 0.017 | 0.100 | 10 | B | A |
| Example 6 | 174 | 159 | 30 | 0.086 | 0.500 | 90 | B | B |
| Example 7 | 174 | 172 | 30 | 0.011 | 0.067 | 10 | C | A |
| Example 8 | 174 | 154 | 30 | 0.115 | 0.667 | 90 | B | C |
| Example 9 | 174 | 173 | 30 | 0.006 | 0.033 | 10 | D | A |
| Example 10 | 170 | 163 | 30 | 0.041 | 0.233 | 50 | A | A |
| Example 11 | 170 | 169 | 30 | 0.006 | 0.033 | 10 | D | A |
| Example 12 | 174 | 173 | 30 | 0.006 | 0.033 | 50 | D | A |
| Example 13 | 174 | 158 | 30 | 0.092 | 0.533 | 50 | A | C |
| Example 14 | 174 | 170.9 | 30.6 | 0.018 | 0.101 | 10 | B | A |
| Example 15 | 174 | 163.8 | 30.6 | 0.059 | 0.333 | 90 | B | A |
| Example 16 | 174 | 171 | 30.6 | 0.017 | 0.098 | 10 | C | A |
| Example 17 | 174 | 163 | 30.6 | 0.063 | 0.359 | 90 | B | B |
| Example 18 | 174 | 167 | 30 | 0.040 | 0.233 | 50 | A | A |
| Comparative Example 1 | 174 | 174 | 30 | 0.000 | 0 | — | E | A |
| Comparative Example 2 | 174 | 173.5 | 30 | 0.003 | 0.017 | 50 | E | A |
| Comparative Example 3 | 174 | 152 | 30 | 0.126 | 0.733 | 50 | A | D |

electrophotographic photosensitive member at an end position of the concave/convex portion forming region where Lmax is measured.

2. The electrophotographic photosensitive member according to claim 1, wherein the concave/convex portion forming region has Lmax and Lmin at each of the end portions in the axial direction of the electrophotographic photosensitive member.

3. A process cartridge that integrally supports a cylindrical electrophotographic photosensitive member and a cleaning unit having a cleaning blade disposed in contact with the electrophotographic photosensitive member, and which is detachably attachable to a main body of an electrophotographic apparatus, the electrophotographic photosensitive member comprising:

a concave/convex portion forming region in which at least one of concave portions and convex portions are formed on a surface of the electrophotographic photosensitive member from a central portion to both end portions in an axial direction of the electrophotographic photosensitive member, wherein $$0.011 \leq (Lmax - Lmin)/Lmax \leq 0.087 \text{ and } 0.100 \leq (Lmax - Lmin)/P \leq 0.333$$

where Lmax and Lmin are respectively maximum and minimum values of a distance L from the central portion to one end portion of the concave/convex portion forming region in the axial direction of the surface of the electrophotographic photosensitive member, and P is a diameter of the electrophotographic photosensitive member, and a ratio of an area of the concave/convex portion forming region to an area of region A is 20 to 80% where region A is a region in an axial end portion of the surface of the electrophotographic photosensitive member that is sandwiched between a surface perpendicular to the axial direction of the electrophotographic photosensitive member at an end position of the concave/convex portion forming region where Lmin is measured, and a surface perpendicular to the axial direction of the electrophotographic photosensitive member at an end position of the concave/convex portion forming region where Lmax is measured.

4. An electrophotographic apparatus, comprising:

a cylindrical electrophotographic photosensitive member, a charging unit, an exposing unit, a developing unit, a transfer unit, and a cleaning unit having a cleaning blade disposed in contact with the electrophotographic photosensitive member; and the electrophotographic photosensitive member comprising a concave/convex portion forming region in which at least one of concave portions and convex portions are formed on a surface of the electrophotographic photosensitive member from a central portion to both end portions in an axial direction of the electrophotographic photosensitive member, wherein $$0.011 \leq (Lmax - Lmin)/Lmax \leq 0.087 \text{ and } 0.100 \leq (Lmax - Lmin)/P \leq 0.333$$

where Lmax and Lmin are respectively maximum and minimum values of a distance L from the central portion to one end portion of the concave/convex portion forming region in the axial direction of the surface of the electrophotographic photosensitive member, and P is a diameter of the electrophotographic photosensitive member, and a ratio of an area of the concave/convex portion forming region to an area of region A is 20 to 80% where region A is a region in an axial end portion of the surface of the electrophotographic photosensitive member that is sandwiched between a surface perpendicular to the axial direction of the electrophotographic photosensitive member at an end position of the concave/convex portion forming region where Lmin is measured, and a surface perpendicular to the axial direction of the electrophotographic photosensitive member at an end position of the concave/convex portion forming region where Lmax is measured.

* * * * *